US010267207B2

(12) United States Patent
Krause et al.

(10) Patent No.: US 10,267,207 B2
(45) Date of Patent: Apr. 23, 2019

(54) MUFFLER FOR AN EXHAUST SYSTEM

(71) Applicant: Eberspächer Exhaust Technology GmbH & Co. KG, Neunkirchen (DE)

(72) Inventors: Michael Krause, Esslingen (DE); Jürgen Häberle, Stuttgart (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 71 days.

(21) Appl. No.: 15/420,598

(22) Filed: Jan. 31, 2017

(65) Prior Publication Data

US 2017/0218830 A1 Aug. 3, 2017

(30) Foreign Application Priority Data

Feb. 1, 2016 (DE) ..... 10 2016 101 693

(51) Int. Cl.

*F01N 1/00* (2006.01)
*F01N 13/18* (2010.01)
*G10K 11/16* (2006.01)

(52) U.S. Cl.

CPC ..... *F01N 13/1844* (2013.01); *F01N 1/00* (2013.01); *F01N 13/1872* (2013.01); *F01N 2450/16* (2013.01); *F01N 2470/20* (2013.01); *F01N 2470/26* (2013.01); *F01N 2490/02* (2013.01); *G10K 11/161* (2013.01)

(58) Field of Classification Search

CPC .... F01N 1/00; F01N 13/1872; F01N 13/1844; F01N 2450/16; F01N 2450/20; F01N 2470/20; F01N 2490/02; G10K 11/161

USPC ..... 181/227, 228

See application file for complete search history.

(56) References Cited

U.S. PATENT DOCUMENTS

| | | | | |
|---|---|---|---|---|
| 1,968,456 | A * | 7/1934 | Kliefoth | F01N 1/24 181/294 |
| 4,473,131 | A * | 9/1984 | Clegg | F01N 13/1844 181/228 |
| 4,475,623 | A * | 10/1984 | Gerber | F01N 13/1844 181/228 |
| 5,290,974 | A * | 3/1994 | Douglas | F01N 13/1805 181/228 |
| 7,434,658 | B2 * | 10/2008 | Staut | F01N 1/083 181/271 |
| 7,543,682 | B2 * | 6/2009 | Hanitzsch | F01N 1/089 180/309 |
| 8,047,328 | B1 * | 11/2011 | Milewicz | F01N 1/00 138/113 |
| 2003/0155175 | A1 * | 8/2003 | Kaku | F01N 1/02 181/227 |
| 2006/0096805 | A1 | 5/2006 | Staut | |
| 2006/0251470 | A1 * | 11/2006 | Prause | B60N 2/1615 403/119 |
| 2007/0051557 | A1 | 3/2007 | Chang | |

(Continued)

FOREIGN PATENT DOCUMENTS

| | | | |
|---|---|---|---|
| DE | 10 2005 026 376 | A1 | 12/2006 |
| DE | 10 2008 020 721 | A1 | 10/2009 |
| DE | 102010015322 | A1 | 10/2011 |

(Continued)

*Primary Examiner* — Forrest M Phillips

(74) *Attorney, Agent, or Firm* — McGlew and Tuttle, P.C.

(57) ABSTRACT

A muffler for an exhaust system includes an exhaust gas duct pipe (20) and a wall (26). The wall (26) is connected to the exhaust gas duct pipe (20) in a first connection area (24) thereof by a thread meshing.

20 Claims, 3 Drawing Sheets

(56) References Cited

U.S. PATENT DOCUMENTS

2016/0017776 A1* 1/2016 Schmidt ..... F01N 13/1844
181/227

FOREIGN PATENT DOCUMENTS

DE 10 2010 015 322 B4 7/2013
EP 0 831 211 A1 3/1998

* cited by examiner

MUFFLER FOR AN EXHAUST SYSTEM

CROSS REFERENCE TO RELATED APPLICATIONS

This application claims the benefit of priority under 35 U.S.C. § 119 of German Application 10 2016 101 693.4 filed Feb. 1, 2016, the entire contents of which are incorporated herein by reference.

FIELD OF THE INVENTION

The present invention pertains to a muffler for an exhaust system, for example, an exhaust system, with which the combustion waste gases generated in an internal combustion engine in a vehicle are discharged to the environment.

BACKGROUND OF THE INVENTION

Such a muffler is known from DE 10 2005 026 376 A1, in which inlet pipes acting as exhaust gas duct pipes are connected in a first connection area to a wall provided in the interior of the muffler and are connected in a second connection area to an outer wall enclosing the interior of the muffler. The inlet pipes are configured with a ring-like bulge, which may run entirely in the circumferential direction or may have a plurality of ring segments, in the first connection area. For connection to this first connection area, the wall has a receiving opening formed in a tubular attachment for a corresponding inlet pipe in a first counter-connection area. The tubular attachment has at its inner circumferential area a bead-like bulge, into which the ring-like bulge of the first connection area can be positioned or engage with the wall in a meshing manner for connection.

DE 10 2010 015 322 B4 discloses a muffler for an exhaust system, in which an exhaust gas duct pipe acting as an inlet pipe has a ring-like recess in a first connection area. A receiving opening for the exhaust gas duct pipe with a plurality of brackets following one another in the circumferential direction and enclosing the receiving opening is formed in a wall to be connected to the exhaust gas duct pipe in this first connection area. A conical lead-in end of the exhaust gas duct pipe is pushed into the receiving opening for connecting the exhaust gas duct pipe to the wall. In this connection, the brackets are deflected in the direction of motion of the exhaust gas duct pipe until they mesh or engage with the ring-like bulge in the exhaust gas duct pipe. In an alternative embodiment, a ring-like recess is formed between two ring-like bulges of the exhaust gas duct pipe positioned at an axial distance to one another for receiving the brackets.

SUMMARY OF THE INVENTION

An object of the present invention is to provide a muffler for an exhaust system, in which an exhaust gas duct pipe can be connected to a wall (wall member) in a simple, yet stable manner.

This object is accomplished according to the present invention by a muffler for an exhaust system, comprising an exhaust gas duct pipe and a wall connected to the exhaust gas duct pipe in a first connection area thereof by thread connection means, a thread-like meshing or thread connection or screw connection of the exhaust gas duct pipe and the wall.

By generating a thread-like meshing (thread connection/screw connection) between the exhaust gas duct pipe and the wall to be connected to it, a bond is obtained which is stable, is easy to establish and essentially does not allow a relative motion between the two components (exhaust gas duct pipe and wall).

An outer threaded formation (thread formation) is advantageously provided at the exhaust gas duct pipe in order to be able to provide this thread-like meshing (thread connection/screw connection) between the exhaust gas duct pipe and the wall. This outer thread formation may be provided, for example, by a helical bulge, i.e., essentially extending in a winding-like manner, in the direction of a longitudinal axis of the exhaust gas duct pipe.

In order to thereby be able to generate a stable meshing with the wall, it is proposed that the bulge provide a thread pitch between bulge areas following one another in the direction of the longitudinal axis of the pipe. The wall meshing with this thread pitch is thus held stable in the axial direction advantageously essentially without clearance of motion by means of the bulge areas being formed in the axial direction.

An essentially uniform and stable connection over the circumference between the exhaust gas duct pipe and the wall can be obtained when the bulge is configured as essentially extending without interruption in the circumferential direction for providing at least one winding, preferably at least two windings. As an alternative to a bulge extending without interruption in the circumferential direction, which can provide a thread pitch correspondingly extending without interruption, bulge segments following one another in the circumferential direction may also be provided, which provide a correspondingly segmented thread pitch in the circumferential direction.

Provisions may be made in an embodiment that is advantageous owing to simple manufacture for the bulge to be configured with an essentially constant thread apex radius or/and thread pitch bottom radius.

In an alternative embodiment, the bulge may be configured with a thread apex radius decreasing towards an end of the exhaust gas duct pipe. This leads to a configuration tapering, and preferably tapering essentially conically, at least on the outside of the exhaust gas duct pipe, which simplifies the defined positioning of the exhaust gas duct pipe in relation to the wall in the direction of the pipe longitudinal axis during the establishing of the thread-like meshing (thread connection/screw connection) with the wall.

For providing the thread-like meshing (thread connection/screw connection) with the first connection area, a first counter-connection area formed at the wall may comprise an exhaust gas duct pipe receiving opening and a plurality of meshing brackets deflectable in the direction of the pipe longitudinal axis enclosing this receiving opening.

In order to make possible the shape adaptation of the wall in its first counter-connection area to the thread-like structure of the exhaust gas duct pipe in a simple manner during the establishing of the thread meshing, it is proposed that meshing brackets following one another in the circumferential direction be separated from one another by notches or recesses, preferably with an essentially radial direction of extension in relation to the pipe longitudinal axis.

The brackets can be caused to mesh or can mesh in a thread-like manner with the outer thread formation by screwing the exhaust gas duct pipe into the receiving opening.

Because a completely gastight connection between the exhaust gas duct pipe and the wall cannot be guaranteed during the establishing of the thread-like meshing (thread connection/screw connection) between these two parts, the wall is preferably an inner wall, and the exhaust gas duct pipe may be connected to another wall, for example, to an outer wall, in a second connection area. The connection pipe is connected in a stable manner to other components or to walls of the muffler in two lengthwise areas of same, preferably each close to a pipe end of same, so that even stronger external forces cannot lead to an undesired deformation or displacement of the exhaust gas duct pipe.

To be able to guarantee a gastight closure especially in the area of the connection to the other wall, it is proposed that the exhaust gas duct be connected to the other wall integrally, and preferably by welding, in the second connection area.

The exhaust gas duct pipe or/and the wall may be constructed from sheet metal material, so that it is possible in a simple manner to bring these components into their desired shape or configuration by means of shaping processes, which are known per se.

The present invention further pertains to an exhaust system for a vehicle with at least one muffler constructed according to the present invention.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
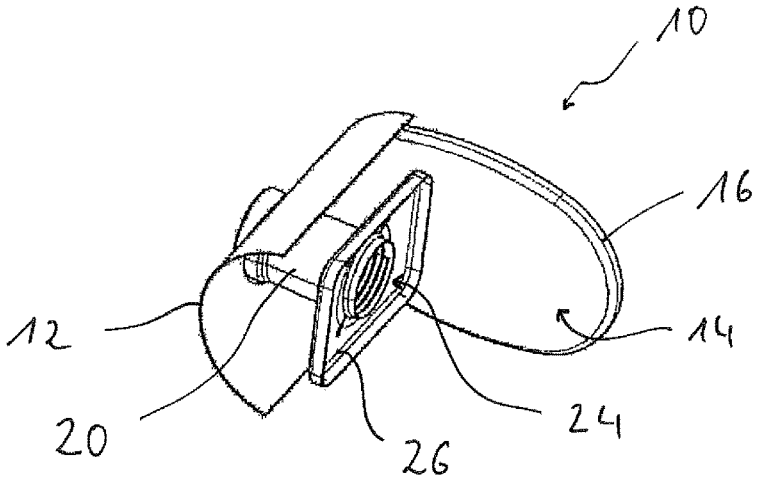
FIG. 1 is a perspective partial view of a muffler.
Figure 2:
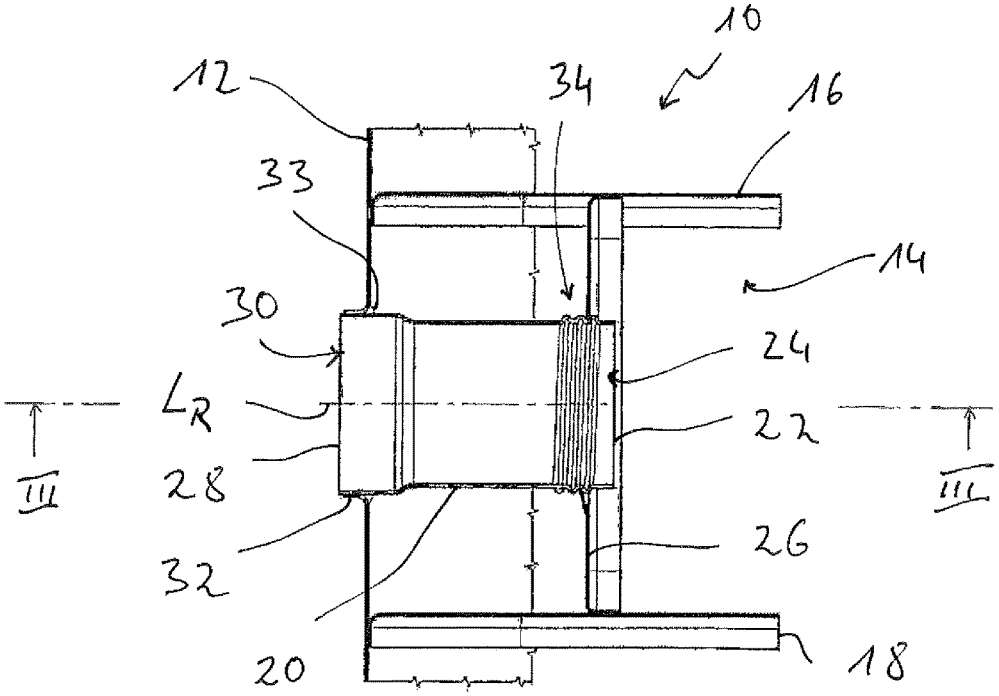
FIG. 2 is a sectional view of the muffler of FIG. 1, cut along a line II-II in FIG. 3.
Figure 3:
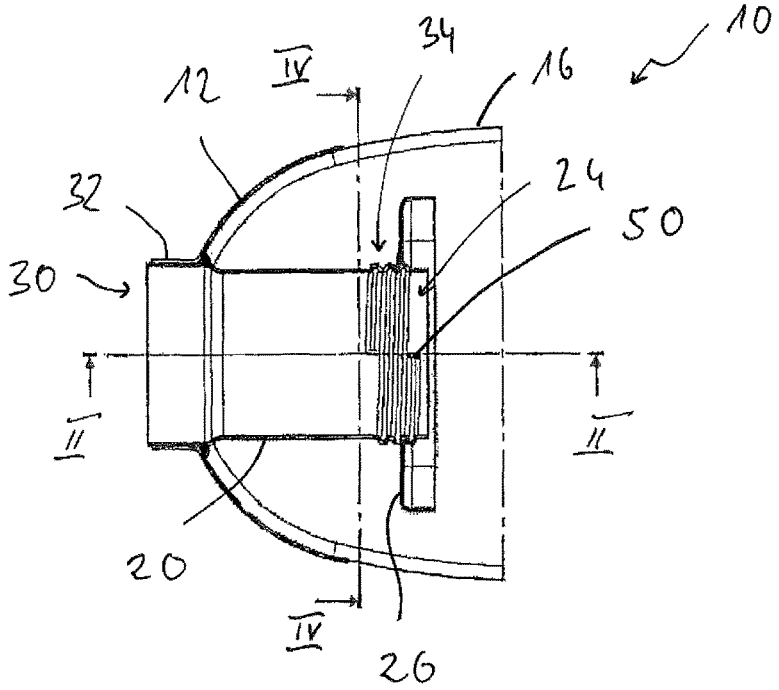
FIG. 3 is a sectional view of the muffler of FIG. 1, cut along a line III-III in FIG. 2.

Referring to the drawings, FIGS. 1 through 5 show a first embodiment of a muffler, which is generally designated by 10, for an exhaust system of an internal combustion engine. It should be pointed out that the muffler is shown in these figures only with components essential for explaining the principles of the present invention.

The muffler 10 comprises an outer wall 12, which is preferably formed from sheet metal material, and intermediate walls 16, 18 defining together with the outer wall 12 an interior 14 of the muffler 10 or dividing the muffler 10 into individual spatial areas. Corresponding walls may also be provided at the end areas of the outer wall 12 shaped, for example, with an elliptical cross section, in order to define the interior 14 in the axial direction outwardly. It should also be mentioned that the outer wall 12 is permanently connected, preferably integrally, e.g., by welding, to the intermediate walls 16, 18 or the end walls, not shown, especially for producing a gastight closure.

The muffler 10 further comprises an exhaust gas duct pipe 20, which may be an inlet pipe in the example shown. The exhaust gas duct pipe 20 is connected to a wall or wall member 26, which forms an inner wall in the example shown, in a first connection area 24, which is explained in detail below and provided in the area of a first pipe end 22. The wall 26 is arranged between the two intermediate walls 16, 18 in the example shown and permanently connected to same, for example, by welding.

The exhaust gas duct pipe is connected to the outer wall 12 in a second connection area 30 formed at a second pipe end 28. In the second connection area 30, the exhaust gas duct pipe 20 has an essentially cylindrical configuration and is pushed into a cylindrical attachment 32 of the outer wall 12, which cylindrical attachment 32 is, for example, outwardly transformed. The exhaust gas duct pipe 20 is connected integrally in a gastight manner (with a gastight connection) to the outer wall in the second connection area 30 by a weld seam 33 preferably extending without interruption in the circumferential direction.

In the first connection area 24, the exhaust gas duct pipe 20 is configured with an outer thread formation 34. Especially if the exhaust gas duct pipe 20 is made of sheet metal material and is thus configured as being comparatively easily deformable, the outer thread formation can be provided by forming a bulge 36 extending helically about a pipe longitudinal axis $L_R$ of the exhaust gas duct pipe 20 in the circumferential direction. This bulge 36 may be formed by means of conventional shaping techniques, e.g., rolling, and thus leads to an essentially undulated structuring of the exhaust gas duct pipe 20 in the first connection area 24.

In the exemplary embodiments shown, the bulge 36 is configured as projecting radially outwards in relation to the pipe longitudinal axis $L_R$ over the otherwise essentially cylindrical exhaust gas duct pipe 20, which is achieved by shaping radially outwards and thus the forming of locally radially extended areas. As an alternative, the bulge 36 may be formed protruding radially inwards in at least some areas due to shaping radially inwards, i.e., over the otherwise essentially cylindrical exhaust gas duct pipe 20.

In the exemplary embodiment shown in FIGS. 1 through 5, the helically extending bulge 36 has an essentially constant thread apex radius $R_S$ over the axial length of the first connection area 24, so that the helically extending bulge has essentially a screw-like wound structure. The thread apex radius $R_S$ also correspondingly increases or decreases only where the radial projecting height of the bulge 36 having a winding-like configuration increases or decreases at the start or at the end of the bulge.

A thread pitch 38 is formed in the bulge areas 36*a* and 36*b* following one another in the direction of the pipe longitudinal axis $L_R$, which are, of course, provided by the sole bulge 36, preferably extending without interruption. In order to configure the thread pitch 38 preferably also without interruption over the entire circumference of the exhaust gas duct pipe 20, the bulge 36 in the exemplary embodiment shown may be provided with at least two windings. It should be pointed out that in the configuration of the bulge 36 by shaping radially inwards, the thread pitch is formed in the area of the bulge itself and the above-mentioned bulge areas, between which a corresponding thread pitch is formed, are provided by areas of the exhaust gas duct pipe 20 that are essentially not deformed radially inwards.

Figure 4:
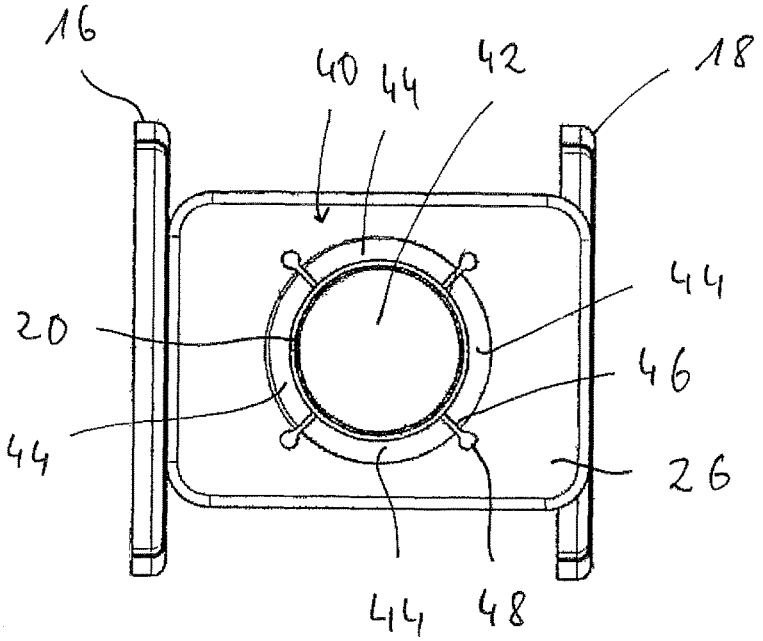
FIG. 4 is a sectional view of the muffler of FIG. 1, cut along a line IV-IV in FIG. 3.
Figure 5:
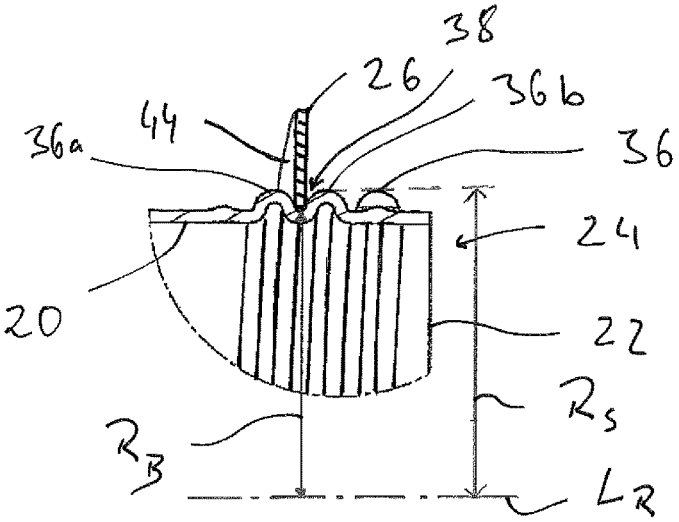
FIG. 5 is an enlarged detail view of an exhaust gas duct pipe connected to a wall by means of thread meshing.

FIG. 4 shows that an exhaust gas duct pipe receiving opening 42 for receiving the exhaust gas duct pipe 20, especially the first connection area 24 of same, is provided at the wall 26 in a first counter-connection area 40. The exhaust gas duct pipe receiving opening 42 is enclosed by a plurality of meshing brackets 44 following one another in the circumferential direction. In the exemplary embodiment shown, four such meshing brackets 44, each extending approximately over an angle range of 90°, are provided. The meshing brackets 44 adjacent to one another or following one another in the circumferential direction are separated from one another in the circumferential direction. In the exemplary embodiment shown, recesses 46 inserting a defined distance, which extend essentially radially in relation to the pipe longitudinal axis $L_R$ and end in their radially outer areas in corresponding circular expansions 48, are provided.

Just like the exhaust gas duct pipe 20, the wall member 26 is also advantageously constructed from sheet metal material. The $R_S$ is thus deformable especially in the area of the meshing brackets 44, so that these brackets can be deflected or bent in the direction of the pipe longitudinal axis $L_R$ in case of a corresponding stress, and can especially be deflected or bent to different degrees, distributed over the circumference.

For establishing the thread-like meshing (thread connection/screw connection) of the first connection area 24 and of the outer thread formation 34 with the first counter-connection area 40, the exhaust gas duct pipe 20 is inserted with its pipe end 22 into the exhaust gas duct pipe receiving opening 42. In this state, the wall 26 has an essentially planar configuration especially in the area of the first counter-connection area 40 with its meshing brackets 44. The exhaust gas duct pipe 20 is pressed with axial pressure against the brackets 44, so that one of the meshing brackets 44 is axially stressed by the start 50 of the bulge 36, which can be seen in FIG. 3, and is deflected in the push-in direction of the exhaust gas duct pipe 20. If the exhaust gas duct pipe 20 is rotated during this process, then the start 50 of the bulge 36 is moved in the direction towards one of the recesses 46. The meshing bracket 44 axially stressed in this state by the bulge 36 is displaced or bent axially in relation to the meshing bracket 44 following in the circumferential direction and not stressed in the axial direction and accordingly not deflected as well. When the rotary motion of the exhaust gas duct pipe 20 is stopped, the start 50 of the bulge 36 is then moved behind the meshing bracket 44 that is not axially deformed or deflected, so that this meshing bracket enters the thread pitch 38. A continued rotary motion or screw motion of the exhaust gas duct pipe 20 leads to all meshing brackets 44 following one another entering the thread pitch 38, until a thread-like meshing (thread connection/screw connection) is finally established between the first connection area 24 at the exhaust gas duct pipe 20 and the first counter-connection area 40 at the wall 26, which is continuous over the entire circumference.

In this state, the first counter-connection area 40 is especially adapted in its shape to the helically extending bulge 36 and the correspondingly helically extending thread pitch 38 in the radial inner area of the meshing brackets 44. This means that each of the meshing brackets 44 meshing with the thread pitch 38, viewed in the circumferential direction, is wound or axially deflected to different degrees.

After the exhaust gas duct pipe 20 has been connected to the wall 26 by screw motion in the manner described above, the exhaust gas duct pipe can be permanently connected to the outer wall 12 in the second connection area 30 in the manner likewise described above, so that a detaching of the first connection area 24 from the first counter-connection area 40 cannot occur even if vibrations occur.

In the manner described above, the exhaust gas duct pipe 20 can be connected in a stable manner to the wall 26 in the interior of the muffler 10 in a simple manner, so that the exhaust gas duct pipe 20 to be connected to another pipe for the construction of an exhaust system in its second connection area is held in a stable manner in the muffler 10 even in case of higher stress. In this connection, the shaping of the helically extending bulge 36 is preferably such that such an intermediate space or the thread pitch 38 with such a width is formed between two bulge areas 36*a*, 36*b* following one another in the axial direction that the wall 26 is received with its first counter-connection area 40 essentially without axial clearance of motion. A slight axial clearance of motion can be compensated thereby or may therefore not lead to vibration-induced noise or rattling, because the meshing brackets 44 are in contact with the bulge 36 under prestress because of the deformation of the meshing brackets for insertion of same into the thread pitch 38.

Figure 6:
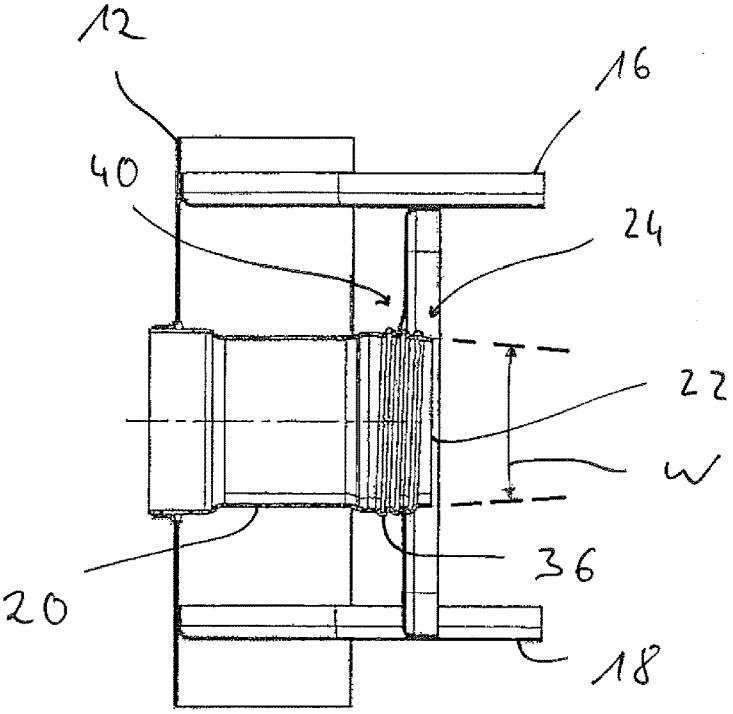
FIG. 6 is a view of an alternative embodiment corresponding to FIG. 2.

FIG. 6 shows a modified embodiment also utilizing the principles of the present invention. The configuration essentially corresponds to the one previously described. A substantial difference is that the exhaust gas duct pipe 20 is shaped in a exhaust gas duct pipe lengthwise area also providing the first connection area 24 such that the thread apex radius $R_S$ decreases in the direction towards the pipe end 22. This can be achieved, for example, by conical configuration or conical deformation of the exhaust gas duct pipe 20. Thus, in this embodiment, the helically extending bulge 36 has a spiral-like structure tapering with an acute angle W.

For connecting the exhaust gas duct pipe 20 to the wall 26, the first connection area 36 is inserted into the exhaust gas duct pipe receiving opening 42 in the manner described above and the thread-like meshing (thread connection/screw connection) is established by rotating. The strength of the frictional interaction between the wall 26 and the exhaust gas duct pipe in case of a continued rotary motion of the exhaust gas duct pipe 20 increases due to the increasing thread apex radius and the correspondingly increasing thread pitch radius. If a defined torque is exerted on the exhaust gas duct pipe 20 during this process, then a defined depth of screwing in of the first connection area 24 in the first counter-connection area can be achieved.

The configuration principles described above for establishing a thread-like meshing (thread engagement or partial thread engagement) or screw connection between an exhaust gas duct pipe and a wall of a muffler may also be embodied in a different way. Thus, a bulge extending without interruption in the circumferential direction, radially outwards or inwards, does not necessarily have to be provided for providing the outer thread formation. Segments of such a helically extending bulge, which are discrete in the circumferential direction and thus spaced apart from one another, can also be used for constructing an outer thread formation. A segment of a thread pitch, in which the meshing brackets of the first counter-connection area can be positioned in a meshing manner, may also be provided between two adjacent segments in the axial direction in such a configuration. The number of brackets provided at the first counter-connection area may also be varied. More or less than four brackets may be provided. A pseudo-sliding fit may be accomplished when using only two brackets and a greater circumferential space of same to one another.

A contact largely preventing a gas leak is established due to the meshing brackets in contact with the bulge under prestress. A minor gas leak, which is, however, negligible for the functionality of the muffler, may occur only where the brackets are separated from one another by the recesses in the circumferential direction and in the area of the circular expansions at the radially outer ends of the recesses.

While specific embodiments of the invention have been shown and described in detail to illustrate the application of the principles of the invention, it will be understood that the invention may be embodied otherwise without departing from such principles.

What is claimed is:

1. A muffler for an exhaust system, the muffler comprising:

an outer wall and end walls at end areas of the outer wall for defining an interior of the muffler together with the outer wall;

a plurality of transverse intermediate walls dividing the interior of the muffler into individual spatial areas;

an exhaust gas duct pipe;

a wall member;

a thread meshing connection connecting the exhaust gas duct pipe to the wall member in a first connection area thereof, the exhaust gas duct pipe being connected to an other wall in a second connection area thereof;

the wall member being an inner wall arranged between two of the intermediate walls and permanently connected to these two intermediate walls.

2. A muffler in accordance with claim 1, wherein the thread meshing connection comprises an outer thread formation and the exhaust gas duct pipe is configured with the outer thread formation in the first connection area.

3. A muffler in accordance with claim 2, wherein the outer thread formation is provided by a bulge extending helically along a longitudinal axis of the exhaust gas duct pipe.

4. A muffler in accordance with claim 3, wherein the bulge provides a thread pitch between bulge areas following one another in the direction of a pipe longitudinal axis.

5. A muffler in accordance with claim 3, wherein the bulge is configured essentially extending without interruption forming at least one winding in a circumferential direction of the exhaust gas duct pipe.

6. A muffler in accordance with claim 3, wherein the bulge comprises a plurality of bulge segments following one another in a circumferential direction of the exhaust gas duct pipe.

7. A muffler in accordance with claim 3, wherein the bulge is configured with an essentially constant thread apex radius or a thread pitch bottom radius or both an essentially constant thread apex radius and a thread pitch bottom radius.

8. A muffler in accordance with claim 3, wherein:

the bulge is configured with a thread apex radius decreasing towards an end of the exhaust gas duct pipe; or the bulge is configured with a thread pitch bottom radius decreasing towards an end of the exhaust gas duct pipe; or the bulge is configured with a thread apex radius decreasing towards an end of the exhaust gas duct pipe and a thread pitch bottom radius decreasing towards an end of the exhaust gas duct pipe.

9. A muffler in accordance with claim 1, wherein the thread meshing connection further comprises a first counter-connection area formed on the wall, the first connection area comprising an exhaust gas duct pipe receiving opening and a plurality of meshing brackets deflectable in the direction of a pipe longitudinal axis enclosing the receiving opening.

10. A muffler in accordance with claim 9, wherein meshing brackets follow one another in the circumferential direction and are separated from one another by notches or recesses with an essentially radial direction of extension in relation to the pipe longitudinal axis.

11. A muffler in accordance with claim 2, wherein:

the thread meshing connection further comprises an outer thread formation;

the exhaust gas duct pipe is configured with the outer thread formation in the first connection area; and the brackets are in thread meshing engagement with the outer thread formation.

12. A muffler in accordance with claim 1, wherein the other wall is the outer wall.

13. A muffler in accordance with claim 12, wherein the exhaust gas duct pipe is connected to the other wall integrally by welding in the second connection area.

14. A muffler in accordance with claim 1, wherein:

the exhaust gas duct pipe constructed from sheet metal material; or the wall is constructed from sheet metal material; or the exhaust gas duct pipe constructed from sheet metal material and the wall is constructed from sheet metal material.

15. An exhaust system for a vehicle, comprising at least one muffler, the at least one muffler comprising:

an outer wall;

end walls arranged at end areas of the outer walls, the outer wall and the end walls defining an interior of the muffler;

a plurality of transverse intermediate walls arranged in the interior of the muffler;

an exhaust gas duct pipe;

a wall member arranged in the interior of the muffler between two of the plurality of intermediate walls and permanently connected to the two intermediate walls;

a thread meshing connection connecting the exhaust gas duct pipe to the wall member in a first connection area thereof;

another wall connected to the exhaust gas duct pipe in a second connection area.

16. An exhaust system in accordance with claim 15, wherein the thread meshing connection comprises an outer thread formation and the exhaust gas duct pipe is configured with the outer thread formation in the first connection area.

17. An exhaust system in accordance with claim 16, wherein the outer thread formation comprises a bulge extending helically along a longitudinal axis of the exhaust gas duct pipe.

18. An exhaust system in accordance with claim 17, wherein the bulge provides a thread pitch between bulge areas following one another in the direction of a pipe longitudinal axis.

19. An exhaust system in accordance with claim 17, wherein the bulge comprises a plurality of bulge segments following one another in a circumferential direction of the exhaust gas duct pipe.

20. An exhaust system in accordance with claim 17, wherein the bulge is configured with an essentially constant thread apex radius or a thread pitch bottom radius or both an essentially constant thread apex radius and a thread pitch bottom radius.

* * * * *